United States Patent [19]

Kasada

[11] Patent Number: 4,682,946

[45] Date of Patent: Jul. 28, 1987

[54] CARBURETION TYPE BURNING APPARATUS

[75] Inventor: Toshio Kasada, Ojima, Japan

[73] Assignee: Mitsubishi Denki Kabushiki Kaisha, Tokyo, Japan

[21] Appl. No.: 783,106

[22] Filed: Oct. 2, 1985

[30] Foreign Application Priority Data

Oct. 11, 1984 [JP] Japan ..... 59-213139

[51] Int. Cl.[4] ..... F23N 5/26

[52] U.S. Cl. ..... 431/14; 431/13; 431/18; 431/78; 340/579

[58] Field of Search ..... 431/13, 14, 15, 18, 431/22, 25, 59, 78, 79, 80, 29; 340/579; 328/6

[56] References Cited

U.S. PATENT DOCUMENTS

| | | | |
|---|---|---|---|
| 4,392,812 | 7/1983 | Yoshii | 431/208 X |
| 4,543,056 | 9/1985 | Sakakibara | 431/29 X |
| 4,561,840 | 12/1985 | Nakamura et al. | 431/78 X |

FOREIGN PATENT DOCUMENTS

| | | | |
|---|---|---|---|
| 0014121 | 1/1982 | Japan | 431/13 |
| 0014122 | 1/1982 | Japan | 431/13 |
| 37624 | 3/1982 | Japan | 431/29 |
| 0168818 | 10/1983 | Japan | 431/78 |

*Primary Examiner*—Margaret A. Focarino

*Attorney, Agent, or Firm*—Oblon, Fisher, Spivak, McClelland, & Maier

[57] ABSTRACT

A carburetion type burning apparatus having a carburetion chamber for evaporating liquid fuel which comprises a timer for counting time from the initiation of burning operation, an ion current detecting device for measuring an ion current (if) at the time after a predetermined time counted by said timer in which the ion current in flames is stabilized, a judging device for judging existence or non-existence of an abnormal burning state by comparing the measured ion current (if) and a predetermined threshold value of ion current which causes abnormal burning condition, and an alarming device for generating an alarm when said judging device provides judgment of abnormal condition.

6 Claims, 5 Drawing Figures

CARBURETION TYPE BURNING APPARATUS

BACKGROUND OF THE INVENTION

1. Field of the Invention

The present invention relates to a carburetion type burning apparatus enabling to generate an alarm when an abnormal state takes place by deposition of tar and undesired substance on the inner wall of a carburetion chamber.

2. Description of Prior Art

As an example of conventional carburetion type burning apparatuses, there has been known one described in Japanese Unexamined Patent Publication No. 98710/1982. In such a burning apparatus, when kerosene evaporates in a carburetion chamber in burning operation, polymerization of molecules constituting kerosene at the temperature causing evaporation and a small amount of residue (impurities) gradually produce tar (carbide), which deposites on the inner wall of the carburetion chamber as the time in the burning operation goes on.

Accumulation of the tar on the carburetion chamber causes clogging of a passage for fuel gas evaporated in the carburetion chamber. As a result, an amount of the fuel gas to be produced becomes small, hence the quantity of burning is small whereby faulty burning may occur. To prevent such disadvantage, the conventional burning apparatus is provided with an additional burning device for burning the tar deposited on the carburetion chamber at a temperature higher than the ordinary carburetion temperature to remove the tar.

An amount of tar deposited on the carburetion chamber largely varies depending on impurities contained in kerosene to be used. Further, time needed for burning to remove the tar is also various because of characteristics of individual burning apparatuses. In many cases, the burning operation has been carried out at the beginning or the last in a period for use. However, the burning operation has often been required even in being used in the case that kerosene containing much impurities has been used.

It is, however, difficult to judge by eyes an initial stage of the abnormal burning condition that tar begins to accumulate on the carburetion chamber to reduce the quantity of burning. As a result, burning operation is continued under abnormal burning condition for a long time until the abnormal burning operation caused by the deposition of much tar becomes visible by eyes. This takes place problems of production of toxic gas, soot and bad smell, and that it takes a long time to remove tar accumulated in thick on the carburetion chamber by additional burning.

SUMMARY OF THE INVENTION

It is an object of the present invention to eliminate the disadvantages of the conventional burning apparatus and to provide a carburetion type burning apparatus generating an alarm informative of necessity of removing tar when the tar is accumulated to some extent on the carburetion chamber.

The foregoing and the other objects of the present invention have been attained by providing a carburetion type burning apparatus having a carburetion chamber for evaporating liquid fuel which comprises a timer for counting time from the initiation of burning operation, an ion current detecting device for measuring an ion current (if) at the time after a predetermined time counted by the timer in which the ion current in flames is stabilized, a judging device for judging existence or non-existence of an abnomal burning state by comparing the measured ion current (if) a predetermined threshold value of ion current which causes abnormal burning condition, and a alarming device for generating an alarm when the judging device provides judgment of abnormal condition.

DETAILED DESCRIPTION OF A PREFFERED EMBODIMENT

An embodiment of the carburetion type burning apparatus according to the present invention wiil be described with reference to drawing.

Figure 1:
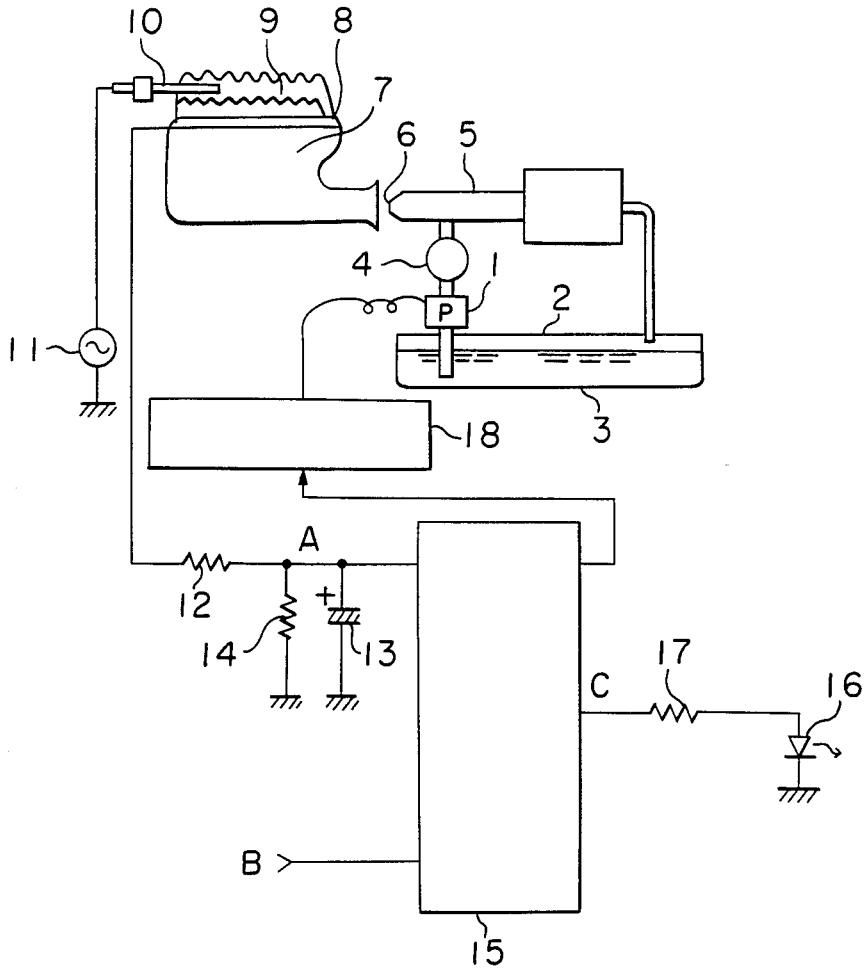
FIG. 1 is a schematic view of an embodiment of the carburetion type burning apparatus according to the present invention.
Figure 4:
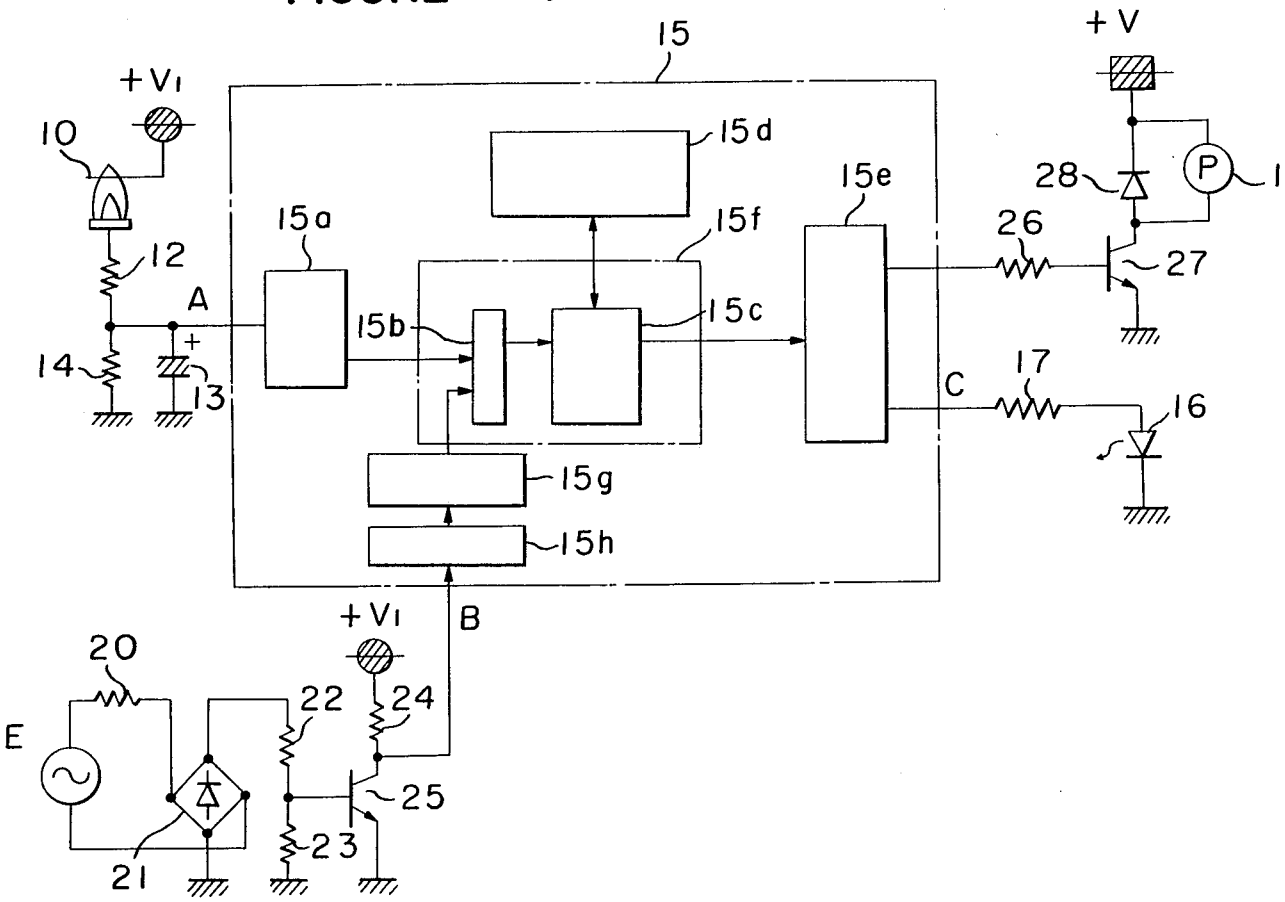
FIG. 4 is a circuit diagram of the embodiment shown in FIG. 1.

In FIGS. 1 and 4 showing the construction of the burning apparatus, a reference numeral 1 designates an electromagnetic pump for supplying kerosene 3 from a fuel tank 2 to a carburetion chamber 4, and a numeral 5 designates an outer tube communicated with the carburetion chamber 4. The outer tube 5 is provided with a nozzle orifice 6 at the extreme end through which fuel gas evaporated in the carburetion chamber 4 is introduced in a burner 7.

A reference numeral 8 designates a burner head, a numeral 9 designates flames from the burner head 8, a numeral 10 designates a flame rod connected to a power source 11 to detect a ion current in the flames, a numeral 12 designates a resistor, a numeral 13 designates a smoothing capacitor and a numeral 14 designates a resistor for converting the ion current into a voltage signal A.

A microcomputer 15 for receiving the voltage signal A comprises an A/D converting circuit 15*a*, a judging device 15*f*, a memory 15*d*, and an output circuit 15*e*. The microcomputer is also provided with a timer 15*g* and a pulse counter 15*h*. The judging device comprises a CPU 15*c* and an input circuit 15*b* wherein an output signal from the A/D converting circuit 15*a* is received to compare it with a value (iO) stored in the memory 15*d*. The A/D converting circuit 15*a* constitutes an ion current detecting device in association with the flame rod 10, the resistors 12, 14 and the capacitor 13.

A reference numeral 20 designates a resistor for dropping the voltage of a commercial power source E having a frequency of 50 Hz, a numeral 21 designates a diode bridge for full-wave rectification of the commercial power source E.

Resistors 22, 23, 24 and a transistor 25 constitute a circuit for generating zero clock pulses as a reference signal B. The pulses in the reference signal B are counted by the pulse counter 15*g* and the timer 15*h* changes a counted value into time. The output circuit 15*e* functions as a signal generating part to generate a signal C so as to operate a light emitting diode 16 in accordance with an output signal from the judging device 15*f*. A numeral 17 designates a current limitting resistor. A resistor 26 and a transistor 27 constitute a circuit for actuating the electromagnetic pump 1 by a pulse signal from the output circuit 15*e*.

A reference numeral 18 designates a burning quantity controlling device which controls the quantity of burning by adjusting operational speed of the electromagnetic pump 1 based on instruction for determining the quantity of burning which is provided by the microcomputer 15.

Figure 5:
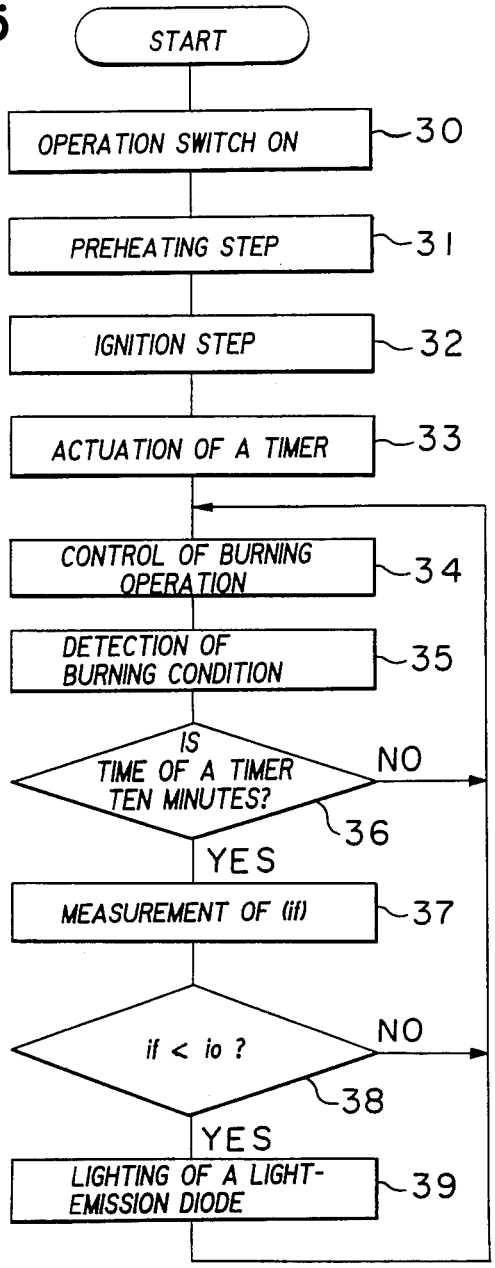
FIG. 5 is a flow chart showing operation of the burning apparatus according to the present invention.

The operation of the burning apparatus of the present invention will be described with reference FIG. 5 showing a flow chart for control operation in FIG. 5.

When an operation switch (not shown) is operated (step 30), preheating of the carburetion chamber 4 by a heater (not shown) is initiated (step 31). When temperature in the carburetion chamber 4 reaches a predetermined value, an ignition step (step 32) is taken together with actuation of the electromagnetic pump 1 by using a pulse signal from the output circuit 15*e*.

Kerosene 3 supplied to the carburetion chamber 4 by means of the electro magnetic pump 1 is evaporated in the carburetion chamber 4 to become fuel gas. The fuel gas is ejected through the nozzle orifice 6 of the outer tube 5 to be introduced in the burner 7 where it is fired for burning. Flames 9 formed in the burning operation produces an ion current between the burner head 8 and the flame rod 10. The ion current is converted into a voltage signal A by the resistor 14 and then, is subjected to digital treatment by the A/D converting circuit 15*a* and thereafter, is input in the judging device 15*f*. On the other hand, the pulse counter 15*h* always receives the reference pulse B produced by using the commercial power source E, and counted pulses are converted into time in the timer 15*g*. At the same time of the firing, the timer is cleared and the operation of the timer is started (step 33). On the completion of the firing operation, a burning control step (step 34) and a burning condition monitoring step (step 35) are repeated.

Then, judgment as to whether a predetermined time (for instance, ten minutes) has lapsed in the timer is made by the judging device 15*f* (step 36). When the predetermined time has lapsed, a signal is supplied to the judging device 15*f* from the timer 15*g*. Then, the judging device compares the ion current (if) with the threshold value (iO) of an ion current which is previously set in the memory 15*d* and expects to cause an abnormal burning phenomenon (step 38). When (if-)<(iO), the burning condition at that time is considered to be abnormal burning condition due to accumulation of tar. Then, a signal C is generated from the output circuit 15*e* as a signal generating part depending on the signal from the judging device 15*f* to thereby operate the light emitting diode 16 as an alarm device (step 39). Then, a switch for additional burning (not shown) is operated by a user so that the interior of the carburetion chamber 4 is heated at a temperature (about 500° C.) higher than a predetermined temperature for evaporation of liquid fuel thereby removing accumulated tar.

Figure 2:
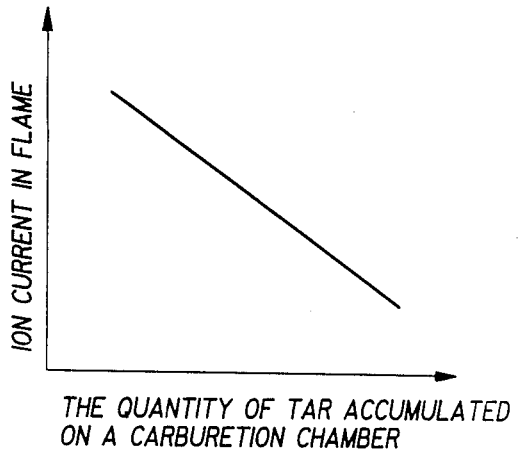
FIG. 2 is a diagram showing a relation between an ion current and the quantity of tar accumulated.

FIG. 2 shows a relation between the quantity of the tar accumulated in the carburetion chamber 4 and an ion current in flames when burning takes place under the condition of the tar accumulation. It is desirable that the threshold value (iO) of an ion current which causes abnormal burning is set in the range from one third to one sixth of an ion current in normal burning conditon. If the threshold value is greater than that range, erroneous operation easily occurs and if small, an alarm may not be generated even when burning condition becomes worse and a large amount of soot is produced.

Figure 3:
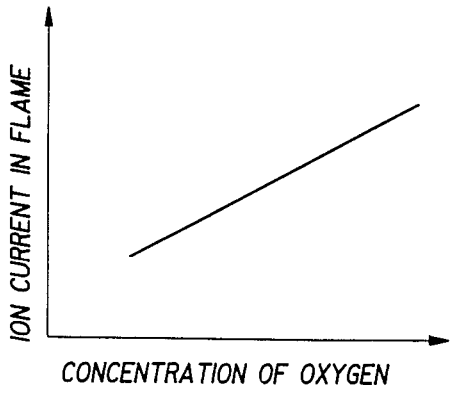
FIG. 3 is a diagram showing a relation between an ion current and the concentration of oxygen.

An ion current in flames is various depending on the concentration of oxygen in air for burning as shown in FIG. 3. Accordingly, when comparison of an ion current (if) with the threshold value (iO) is carried out after a long time burning operation in a room of poor ventilation, an alarm may be generated regardless of the quantity of tar accumulated in the carburetion chamber 4 since the ion current is decreased due to the short of oxygen. Accordingly, measurement of (if) and comparison of (if) with (iO) should be carried out at the time when an ion current in flames is substantially stabilized, for instance, about 10 to 20 minutes after the initiation of burning operation.

In accordance with the present invention, it is unnecessary to judge by eyes whether or not abnormal burning condition takes place; additional burning operation can be carried out before generation of toxic gas, soot and bad smell; and removal of tar can be performed in a short time by the additional burning because an amount of tar accumulated in the carburetion chamber is small.

What is claimed is:

1. A carburetion type burning apparatus having a carburetion chamber for evaporating liquid fuel which comprises a timer for counting time from the initiation of burning operation, an ion current detecting device positioned in the flames for measuring an ion current in the flames (if) at the time after a predetermined time counted by said timer in which the ion current in flames is stabilized, a judging device for judging existence or non-existence of an abnormal burning state by comparing the measured ion current (if) and a predetermined open threshold value of ion current which causes abnormal burning condition, a burning quantity controlling device for controlling the quantity of fuel to be burned in response to the output from said judging device and an alarming device for generating an alarm when said judging device provides judgment of abnormal condition.

2. A carburetion type burning apparatus according to claim 1, wherein said ion current detecting device comprises a flame rod, resistors, a capacitor and an A/D converting circuit.

3. A carburetion type burning apparatus according to claim 2, wherein said judging device compares the ion current (if) from said A/D converting circuit with the threshold value (iO) stored in a memory.

4. A carburetion type burning apparatus according to claim 1, wherein said alarming device is constituted by a light emitting diode.

5. A carburetion type burning apparatus having a carburetion chamber for evaporating liquid fuel, said apparatus comprising:

timer for measuring the time from the intitiation of burning operation;

an ion current detecting device positioned in the flames for measuring an ion current in the flames;

an A/D converter for receiving thc output from said ion current detecting device for converting said ion current into a digital signal;

a memory means for digitally storing a threshold value of the ion current;

a judging device for comparing said digital value from said converter and said threshold value from said memory to determine the presence of an abnormal burning state;

an output circuit receiving the result of said judging device;

a burning quantity controlling device for controlling the quantity of fuel to be burned, said controlling device receiving a pulse signal from said output circuit and actuating a fuel pump in response thereto; and an alarm device for generating an alarm when an abnormal burn state exists.

6. A carburetion type burning apparatus according to claim 5, further comprising:

a constant frequency power source;

a clock circuit connected to said constant frequency power circuit for generating clock pulses;

said timer connected to said clock circuit and receiving said clock pulses.

* * * * *